United States Patent [19]

Giusto et al.

[11] Patent Number: 4,582,780

[45] Date of Patent: Apr. 15, 1986

[54] MULTILAYER COLOR PHOTOGRAPHIC LIGHT SENSITIVE MATERIAL

[75] Inventors: Giovanni Giusto, Altare; Elio de Saraca, Carcare, both of Italy

[73] Assignee: Minnesota Mining and Manufacturing Company, St. Paul, Minn.

[21] Appl. No.: 653,343

[22] Filed: Sep. 24, 1984

[30] Foreign Application Priority Data

Sep. 30, 1983 [IT] Italy ..... 65214 A/83

[51] Int. Cl.[4] ..... G03C 7/00

[52] U.S. Cl. ..... 430/505; 430/17; 430/506; 430/507; 430/509; 430/510

[58] Field of Search ..... 430/506, 509, 505, 510, 430/507, 17

[56] References Cited

U.S. PATENT DOCUMENTS

| | | | |
|---|---|---|---|
| 3,726,681 | 4/1973 | Opladen et al. | 430/506 |
| 3,843,369 | 10/1974 | Kumuai et al. | 96/74 |
| 3,932,185 | 1/1976 | Matsuura | 430/505 |
| 4,186,016 | 1/1980 | Lohmann et al. | 430/507 X |
| 4,388,401 | 6/1983 | Hasebe et al. | 430/509 X |
| 4,414,308 | 11/1983 | Hamada | 430/509 X |
| 4,438,194 | 3/1984 | Hamada | 430/506 X |

FOREIGN PATENT DOCUMENTS

| | | |
|---|---|---|
| 923045 | 4/1963 | United Kingdom . |
| 2010818 | 7/1979 | United Kingdom . |
| 2072363 | 9/1981 | United Kingdom . |

*Primary Examiner*—John E. Kittle
*Assistant Examiner*—Mukund J. Shah
*Attorney, Agent, or Firm*—Donald M. Sell; James A. Smith; Mark A. Litman

[57] ABSTRACT

Adjacency effects of a color photographic material may be increased by dividing a light-sensitive silver halide emulsion layer into three emulsion layers sensitive to the same spectral region of the visible light, the uppermost silver halide emulsion layer of which has the highest sensitivity and the lowermost silver halide emulsion layer has the lowest sensitivity, wherein the maximum color density of the uppermost silver halide emulsion layer, after color development, is lower than 0.60 and the maximum color density of both the intermediate and lowermost silver halide emulsion layers, after color development, are each higher than 0.60.

10 Claims, 2 Drawing Figures

3.0
D
2.0
1.0
D
B
C
A
LOG E
0
1.0
2.0
3.0
4.0
5.0

3.0
D
2.0
1.0
H
G
E
F
LOG E
0
1.0
2.0
3.0
4.0
5.0

MULTILAYER COLOR PHOTOGRAPHIC LIGHT SENSITIVE MATERIAL

FIELD OF THE INVENTION

The present invention relates to a multilayer color photographic light-sensitive material and more particularly to a multilayer color photographic light-sensitive material having blue-, green- and red-sensitized silver halide emulsion layers associated with non-diffusing color couplers and capable of providing improved color images upon development in a color developer comprising an aromatic primary amino developing agent.

BACKGROUND OF THE ART

Color photographic light-sensitive materials generally are composed of a supporting base having thereon a red-sensitive silver halide emulsion layer containing cyan-dye forming couplers, a green-sensitive silver halide emulsion layer containing magenta-dye forming couplers and a blue-sensitive silver halide emulsion layer containing yellow-dye forming couplers, wherein cyan, magenta and yellow dye images are respectively formed upon exposure and color development with aromatic primary amino developing agents.

In particular, color camera films (both negative and reversal films) are prepared by coating on the supporting base (such as cellulose triacetate films, polyethylene terephthalate films, and the like) an antihalation layer, a red-sensitive layer, a green-sensitive layer, a yellow filter layer and a blue-sensitive layer.

The silver halide emulsions frequently used for such photographic materials were the so-called mixed emulsions, that is, emulsions comprising a combination of a more sensitive emulsion (containing coarse silver halide grains) and a less sensitive emulsion (containing fine silver halide grains) whereby a straight density-log exposure curve with extended exposure latitude can be obtained for each blue-, green- and red-sensitive layer.

It is known that the granularity of the dye image in color photographic materials depends mainly upon the size of the silver halide grains employed. Therefore, attempts to increase the sensitivity of the color photographic material by increasing the size of the silver halide grains (sensitivity of silver halide grains generally is proportional to the size of the silver halide grains) cause a coarsening of the granularity of the dye image.

British Pat. No. 923,045 describes a method for increasing the sensitivity of a color photographic material without coarsening the granularity of the dye image by providing the color photographic material with an uppermost more sensitive emulsion layer and a lowermost less sensitive emulsion layer, sensitive to the same region of the visible spectrum and each containing non-diffusing color couplers, with the maximum color density of the more sensitive emulsion layer being adjusted to be lower than that of the less sensitive emulsion layer, in particular from 0.20 to 0.60.

French Pat. No. 2,043,433 describes a method to improve the granularity in high-sensitivity color camera films (in such films the silver halide grains of the emulsion layers must be inevitably coarser) by providing the color photographic material with three emulsion layers sensitive to the same spectral region of visible light, the uppermost silver halide emulsion layer having the highest light sensitivity and the lowermost silver halide emulsion layer having the lowest light sensitivity, the uppermost and the intermediate layer each having a maximum density of 0.6 or less.

The Applicant has confirmed that such a three-layer structure, which consists of an uppermost, an intermediate and a lowermost emulsion layer respectively having a coarse, a mean and a fine grain structure, leads to an improved granularity in comparison with a two-layer structure, wherein the fine grain emulsion and the coarse grain emulsion are coated onto the base in this order, even if the average grain size and the distribution thereof are the same in both structures.

Unfortunately, when examining the structure of the developed image in a color camera film using such three-layer structure, some negative influence on the so-called adjacency effects (such as the Eberhard or vertical effect) was noticed. The adjacency effects, as known, are originated by an uneven development of two contiguous areas of a photographic material that receive exposures of different magnitude (the Eberhard effect being an increase in color density profiles with decreasing size when very small line images of varying sizes are photographed). Lack or decrease of such adjacency effects may adversely affect sharpness and brilliance of the developed image.

SUMMARY OF THE INVENTION

It has been found that adjacency effects of a color photographic material may be increased by dividing a light-sensitive silver halide emulsion layer into three emulsion layers sensitive to the same spectral region of the visible light, the uppermost silver halide emulsion layer of which has the highest sensitivity and the lowermost silver halide emulsion layer has the lowest sensitivity, wherein the maximum color density of the uppermost silver halide emulsion layer, after color development, is lower than 0.60 and the maximum color density of both the intermediate and the lowermost silver halide emulsion layers, after color development, are each higher than 0.60.

DETAILED DESCRIPTION OF THE INVENTION

Figure 1:
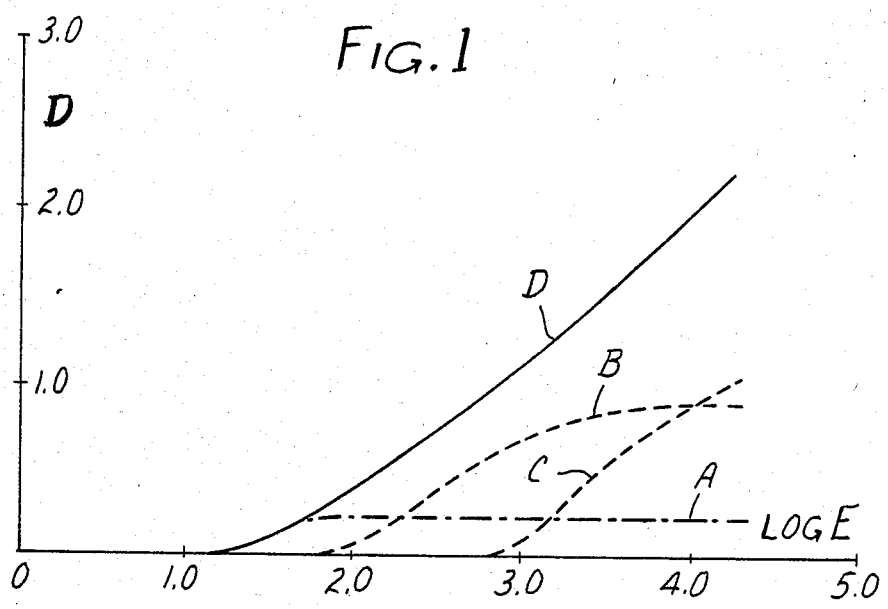

The present invention relates to a multicolor photographic light-sensitive material having blue-, green- and red-sensitized silver halide emulsion layers associated with non-diffusing color couplers, which comprises three silver halide emulsion layers sensitized to the same spectral region of visible light, the uppermost silver halide emulsion layer of which has the highest sensitivity and the lowermost silver halide emulsion layer has the lowest sensitivity, wherein the maximum color density of the uppermost silver halide emulsion layer, after color development, is lower than 0.60 and the maximum color density of both the intermediate and the lowermost silver halide emulsion layers, after color development, are each higher than 0.60.

Preferably, the present invention relates to a multilayer color photographic material, as described above, wherein the sum of the maximum color densities of the uppermost and intermediate layers, after color development, is higher than 1.0.

Still preferably, the present invention relates to a multilayer color photographic material, as described above, wherein the sum of the maximum color densities of the uppermost and intermediate layers is equal or higher than the maximum color density of the lowermost layer.

More preferably, the present invention relates to a multilayer color photographic material, as described above, wherein the maximum color density of the intermediate layer, after color development, is higher than 0.80.

In particular, the present invention relates to a multilayer color photographic material, as described above, which comprises a plurality of red-sensitized layers including a fine-grain low-sensitivity silver halide emulsion layer, a mean-grain medium-sensitivity silver halide emulsion layer and a coarse-grain high-sensitivity silver halide emulsion layer, said fine-grain low-sensitivity layer being the closest one to the supporting base among the layers which constitute said plurality of layers.

Preferably, the present invention relates to a multilayer color photographic material as described above, which consists of a supporting base having coated thereon in the order an antihalation layer, three layers of silver halide emulsion sensitized to the red light, but of different sensitivity and containing cyan-dye forming couplers, two layers of silver halide emulsion sensitized to the green light, but of different sensitivity and containing magenta-dye forming couplers, a yellow-dye filter layer and two layers of silver halide emulsion sensitized to the blue light, but of different sensitivity and containing yellow-dye foming couplers.

More in particular, the present invention relates to a multilayer color photographic material, as described above, in which the silver halide emulsions utilize gelatin as dispersing medium and non-diffusing color couplers dispersed therein.

Still more in particular, the present invention relates to a multilayer color photographic material as described above in which the concentration of the coupler in the intermediate silver halide emulsion layer of medium sensitivity is 2 to 10 times the concentration of the coupler of the uppermost silver halide emulsion layer of high-sensitivity.

In another aspect, the present invention relates to a process for the production of improved color images which comprises exposing the material described above to a colored object and developing the exposed material in a color forming developer.

In a further aspect, the present invention relates to improved color images produced by the process described above.

Figure 2:
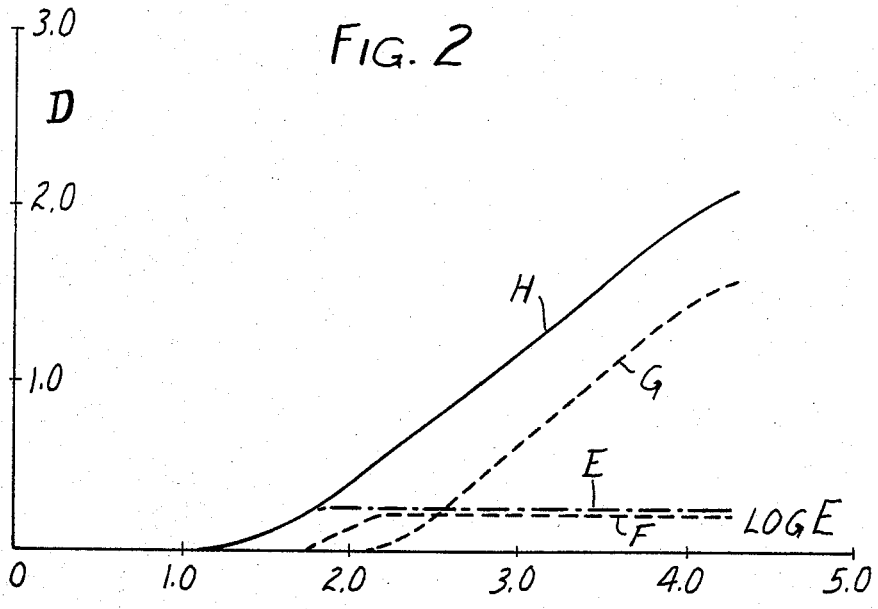

The invention will be more clearly understood by referring to the following description in conjunction with the attached drawings in which FIG. 1 is a Density-log Exposure graph of a three layer structure according to the present invention and FIG. 2 is a Density-log Exposure graph of a three-layer structure as known in the art (see French Pat. No. 2,043,433).

In particular, FIG. 1 shows three layers of silver halide photographic emulsions, sensitized to the same spectral region of visible light, superimposed on a support base, each emulsion layer having a maximum color density, after color development, according to the present invention: Curve A represents the Density-log Exposure (D-log E) response of the uppermost most sensitive emulsion layer, Curve B represents the D-log E response of the intermediate medium-sensitive emulsion layer, Curve C represents the D-log E response of the lowermost least sensitive emulsion layer and Curve D represents the effective D-logE response of the superimposed three-layer structure resulting from the accumulated densities of all the three emulsion layers and having the straight D-log E curve with extended exposure latitude suitable for color camera films. FIG. 2 shows three layers of silver halide photographic emulsions, sensitized to the same spectral region of visible light superimposed on a support base, each emulsion layer having a maximum color density, after color development, according to the prior art: Curve E is the D-log E response of the uppermost most sensitive emulsion layer, curve F is the D-log E response of the intermediate medium-sensitive emulsion layer, curve G is the D-log E response of the lowermost least sensitive emulsion layer and curve H is the effective accumulated D-log E response of the three superimposed layers.

The maximum color density of each emulsion layer can be adjusted to the desired values according to the present invention by lowering or increasing the quantity of the color coupler (or couplers) in the considered layer (and correspondingly lowering or increasing the quantity of silver). Of course, the maximum color density of the multilayer color photographic material will vary depending upon the desired "effective" curve which, according to the mixing law, is formed by accumulating the densities of all of the three emulsions. In case of color negative camera films such effective curve generally has a maximum color density in the range of 1.5 to 2.5, preferably in the range of 1.8 to 2.2. To the purposes of the present invention the color density of a single layer is given with respect to the density provided for by a plurality of layers contributing to form the same color upon exposure and development of a photographic film containing them and is calculated from the measured total color density of the considered color (either cyan, magenta or yellow) multiplied by the percent quantity of the coupler(s) in the layer with respect to the total quantity of coupler(s) in such plurality of layers forming the same color.

To obtain the benefits of this invention, the quantity of the color coupler (or couplers) in the intermediate medium-sensitivity emulsion layer should range from about 2 to about 10 times, preferably from about 3 to about 6 times the quantity of the color coupler in the uppermost high-sensitivity emulsion layer and, in case of color negative camera films, is comparable to or even higher than that of the lowermost low-sensitive emulsion layer. By reducing the coupler quantity in the uppermost highly sensitive emulsion layer, a low density curve, after color development, is obtained in this layer which does not appreciably contribute in density to the middle portion of the effective curve which is important for the image. This is mainly determined by both the intermediate and lowermost emulsion layer having high color densities. No coarsening of the granularity of the dye image is noticed while adjacency effects have been found which result into improved sharpness and brilliance of the image in this construction.

As far as the sensitivity differences between the three emulsion layers is concerned, these can be chosen as known in the art according to the characteristic D-logE curve to be obtained. In a color camera film, a D-logE curve is desired which must be straight, even (without humps), and having a wide exposure latitude. This is accomplished by using coarse grain size silver halide emulsions in the uppermost emulsion layer (that gives the threshold sensitivity to the material), and respectively mean and fine grain size silver halide emulsions in the intermediate and lowermost emulsion layers (which determine the grain nature and the image quality of the material).

The three-layer emulsion construction of the present invention can be applied effectively to a cyan-dye forming emulsion layer, a magenta-dye forming emulsion layer and/or to a yellow-dye forming emulsion layer arranged on a support base in the above described order or reversed or in any other layer arrangement such as those described for example in U.S. Pat. Nos. 3,658,536 and 4,165,236. The silver halide emulsion layer according to the present invention consists of three emulsion layers sensitive to the same spectral region, but it will be understood that the emulsion layer can consist of four or more layers. Non-photosensitive gelatin intermediate layers can be present between the three emulsion layers sensitive to the same spectral region of the present invention. Such intermediate layers may also contain antioxidants which prevent developer oxidation products from diffusing from one layer into another and/or silver halide fine grains of comparatively very low sensitivity which have particularly beneficial effects upon the sensitivity of the layers. Such intermediate layers, particularly when coated between the mean-grain medium-sensitivity silver halide emulsion and the fine-grain low-sensitivity silver halide emulsion layer have shown positive effects on image granularity.

The silver halide emulsion used in this invention may be a fine dispersion of silver chloride, silver bromide, silver chlorobromide, silver iodobromide and silver chloroiodobromide in a hydrophilic binder. As hydrophilic binder, any hydrophilic polymer of those conventionally used in photography can be advantageously employed including gelatin, a gelatin derivative such as an acylated gelatin, a graft gelatin, etc., albumin, gum arabic, agar agar, a cellulose derivative such as hydroxyethyl cellulose, carboxymethyl cellulose, etc., a synthetic resin such as polyvinyl alcohol, polyvinyl pyrrolidone, polyacrylamide, etc. Preferred silver halides are silver iodo-bromide or silver iodobromochloride containing 1 to 12% moles of silver iodide. The silver halide grains may have any crystal form such as cubical, octahedral, tabular or a mixed crystal form. The silver halide can have a uniform grain size or a broad grain size distribution. Also of the silver halide ranges from about 0.1 micron to about 3 microns. The silver halide emulsion can be prepared using a single-jet method, a double-jet method, or a combination of these methods or can be matured using, for instance, an ammonia method, a neutralization method, an acid method, etc.

The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other anxiliary substances, as for instance described in Research Disclosure 17643, V, VI, VIII, X, XI and XII, December 1978.

The layers of the photographic emulsion and the layers of the photographic element can contain various colloids, alone or in combination, such as binding materials, as for instance described in Research Disclosure 17643, IX, December 1978.

The dye-forming couplers used to form yellow, magenta and cyan dye images are two and four equivalent non-diffusing colorless couplers of the open-chain ketomethylene, pyrazolone, pyrazolotriazole, pyrazolobenzimidazole, phenol and naphthol type, such as those described in Research Disclosure 17643, VII D and E, September 1978. The dye-forming couplers can upon coupling release photographically useful fragments, such as development inhibitors or accelerators, bleach accelerators, developing agents, silver halide solvents, antifoggants, competing couplers and those described in Research Disclosure above, VII F and in British patent application Ser. Nos. 2,010,818 and 2,072,363. The photographic emulsion layers can incorporate colored dye-forming couplers, such as those employed to form integral masks for negative color images, as illustrated in the above mentioned Research Disclosure, VII, G, antistain agents, such as non diffusing hydroquinones as illustrated in the above mentioned Research Disclosure, VII I and dye stabilizers as illustrated in the above mentioned Research Disclosure VII J.

In order to render the color coupler non-diffusing, a group having a hydrophobic residue with about 8 to 32 carbon atoms is introduced into the coupler molecule. Such a residue is called "ballast group" and is linked to the coupler molecule durectly or through an imino, ether, carbonamido, sulfonamido, ureido, ester, imido, carbamoyl, sulfamoyl, etc. bond. Examples of ballast groups are specifically illustrated in U.S. Pat. No. 4,009,038. To give an idea of the total weight of the substituents introduced, a coupler can be said to have a molecular weight normally comprised between 500 and 700.

Said couplers can be introduced into the photographic layers (generally into the silver halide emulsion layer or into a layer adjacent thereto and in reactive association therewith) by various methods known in the art. Couplers having a water-soluble group, such as a carboxyl group, a hydroxy group, a sulfonic acid group or a sulfonamido group, can be introduced according to the Fisher process, i.e. by dissolving them in an alkaline water solution and then adding them to the silver halide emulsion. Hydrophobic couplers can be added to the silver halide emulsion by dissolving them in a high boiling solvent and then dispersing them in gelatin as described for example in U.S. Pat. Nos. 2,322,027, 2,801,170, 2,801,171, and 2,991,177 or, alternatively, by charging them on droplets of suitable polymeric latexes as described for example in Belgian Pat. Nos. 853,512 and 869,816, in U.S. Pat. Nos. 4,214,074 and 4,199,363 and in European patent application Ser. No. 14,921. Also couplers which form colorless compounds, as described in British Pat. No. 861,138, can be used in combination with normal color forming couplers.

The above described emulsions can be coated onto several support bases (cellulose triacetate, paper, resin-coated paper, polyester included) by adopting various methods, as described in Research Disclosure 17643, XV and XVII, December 1978.

The light-sensitive silver halide contained in the photographic elements of the present invention after exposure can be processed to form a visible image by associating the silver halide with an aqueous alkaline medium in the presence of a developing agent contained in the medium or in the element. Processing formulations and techniques are described in Research Disclosure 17643, XIX, XX and XXI, December 1978.

The present invention is now described with more details by reference to the following example.

EXAMPLE 1

Two multilayer color photographic films were prepared as follows:

Film A was prepared by coating a cellulose triacetate support base, subbed with gelatin, with the following layers in the following order:

(a) a layer of black colloidal silver dispersed in gelatin having a silver coverage of 0.2 g/m$^2$ and a gelatin coverage of 4 g/m$^2$;

(b) a layer of a low-sensitivity red-sensitive silver halide emulsion comprising a blend of a low-sensitivity silver bromo-iodide emulsion (having 2% silver iodide moles and a mean grain size of 0.25$\mu$) and a medium-sensitivity silver chloro-bromo-iodide emulsion having 7% silver iodide moles and 5% silver chloride moles and a mean grain size of 0.35$\mu$) at a total silver coverage of 0.95 g/m$^2$ and a gelatin coverage of 2.9 g/m$^2$, containing two cyan-dye forming couplers at a coverage of 0.693 g/m$^2$ dispersed in tricresylphosphate;

(c) a layer of a medium-sensitivity red-sensitive silver halide emulsion comprising a silver bromo-iodide emulsion (having 7% silver iodide moles and a mean grain size of 0.7$\mu$) at a silver coverage of 1.2 g/m$^2$ and a gelatin coverage of 1.6 g/m$^2$, containing two cyan-dye forming color couplers at a coverage of 0.103 g/m$^2$ dispersed in tricresylphosphate;

(d) a layer of a high-sensitivity red-sensitive silver halide emulsion comprising a silver bromo-iodide emulsion (having 7% silver iodide moles and a mean grain size of 1$\mu$) at a silver coverage of 2.05 g/m$^2$ and a gelatin coverage of 2.9 g/m$^2$, containing two cyan-dye forming color couplers at a coverage of 0.107 g/m$^2$ dispersed in tricresylphosphate;

(e) an intermediate layer containing 1.16 g/m$^2$ of gelatin and 0.14 g/m$^2$ of 2,5-diisooctylhydroquinone dispersed in tricresylphosphate;

(f) a layer of a green-sensitive silver halide emulsion comprising the blend of silver halide emulsions of layer (b) at a silver coverage of 1.2 g/m$^2$ and a gelatin coverage of 3.3 g/m$^2$, containing three magenta-dye forming couplers at a coverage of 0.6 g/m$^2$ dispersed in tricresylphosphate;

(g) a layer of medium-sensitivity green-sensitive silver bromo-iodide emulsion (having 7% silver iodide moles and a mean grain size of 0.7$\mu$) at a silver coverage of 2.2 g/m$^2$ and a gelatin coverage of 2.7 g/m$^2$, containing three magenta-dye forming couplers at a coupler coverage of 0.2 g/m$^2$ dispersed in tricresylphosphate;

(h) a yellow filter layer containing 1 g/m$^2$ of gelatin, yellow colloidal silver and 0.05 g/m$^2$ of 2,5-diisooctylhydroquinone dispersed in tricresylphosphate;

(i) a layer of low-sensitivity blue-sensitive silver halide emulsion comprising the blend of silver halide emulsion of layer (b) at a silver coverage of 0.75 g/m$^2$ and a gelatin coverage of 3.7 g/m$^2$ and a yellow-dye forming coupler at a coverage of 1.5 g/m$^2$ dispersed in tricresylphosphate;

(l) a layer of medium-sensitivity blue-sensitive silver bromo-iodide emulsion (having 7% silver iodide moles and a mean grain size of 0.7$\mu$) at a silver coverage of 0.9 g/m$^2$ and a gelatin coverage of 2.3 g/m$^2$, containing a yellow-dye forming coupler at a coverage of 0.37 g/m$^2$ dispersed in tricresylphosphate;

(m) a protective layer of 1 g/m$^2$ of gelatin containing polymethylmethacrylate and a dispersion of 2-(2'-hydroxy-3',5'-ditert.-butylphenyl)-5-tert.-butyl-benzotriazole in a mixture of tricresylphosphate and dibutylphthalate.

Film B was prepared by coating a cellulose triacetate support base, subbed with gelatin, with the following layers in the following order:

(a) the layer of black colloidal silver dispersed in gelatin of Film A;

(b) a layer of a low-sensitivity red-sensitive silver bromo-iodide emulsion (having 7% silver iodide moles and a mean grain size of 0.25$\mu$) at a silver coverage of 0.75 g/m$^2$ and a gelatin coverage of 2.3 g/m$^2$, having the two color couplers of layer (b) of Film A at a coverage of 0.46 g/m$^2$ dispersed in tricresylphosphate;

(c) a layer of medium-sensitivity red-sensitive silver halide emulsion comprising a blend of a medium-sensitivity silver chloro-bromo-iodide emulsion (having 7% silver iodide moles, 5% silver chloride moles and a mean grain size of 0.35$\mu$) and a high-sensitivity silver bromo-iodide emulsion (having 7% silver iodide moles and a mean grain size of 0.7$\mu$) at a total silver coverage of 1.65 g/m$^2$ and a gelatin coverage of 2.2 g/m$^2$, containing the two cyan dye forming couplers of Film A at a coverage of 0.41 g/m$^2$ dispersed in tricresylphosphate, (d) a layer of a high-sensitivity red-sensitive silver halide emulsion comprising a silver bromo-iodide emulsion (having 7% silver iodide moles and a mean grain size of 1$\mu$) at a silver coverage of 2.05 g/m$^2$ and a gelatin coverage of 2.9 g/m$^2$, containing the two cyan dye forming couplers of Film A at a coverage of 0.11 g/m$^2$ dispersed in tricresylphosphate;

(e) the intermediate gelatin layer (e) of Film A;

(f) the low-sensitivity green-sensitive layer (f) of Film A;

(g) the medium sensitivity green-sensitive layer (g) of Film A;

(h) the yellow filter layer (h) of Film A;

(i) the low-sensitivity blue-sensitive layer (i) of Film A;

(l) the medium-sensitivity blue-sensitive layer (l) of Film A;

(m) the protective gelatin layer (m) of Film A.

Samples of the two films were exposed to 5500° K. light through a grey step wedge, then subjected to a standard Kodak C41 process for color negative films.

The following table reports the sensitometric results.

| FILM | A | B |
|---|---|---|
| MAXIMUM OPTICAL DENSITY | | |
| Layer b | 1.62 | 1.05 |
| Layer c | 0.24 | 0.92 |
| Layer d | 0.25 | 0.24 |
| SENSITIVITY (logE) | | |
| Layer c–Layer b | 0.32 | 0.90 |
| Layer d–Layer c | 0.36 | 0.50 |
| CONTRAST | | |
| (i) | 0.68 | 0.64 |
| (ii) | 0.74 | 0.79 |
| %Δ CONTRAST $\left(\frac{ii - i}{i} \cdot 100\right)$ | +8.8 | +23.5 |
| GRANULARITY (mV) MEASURED AT: | | |
| D = 0.8 | 17 | 17 |
| D = 1.5 | 17 | 19 |

(i) = exposure through grey 0.3 wedge.
(ii) = exposure through grey 0.3 wedge + W29R filter.

The data reported above show that Film B (having a triple cyan layer construction according to the present invention as shown in FIG. 1) has a remarkable increase in Δ contrast when compared with Film A (having a triple cyan layer construction according to the prior art as shown in FIG. 2). Δ contrast is a measure of the adjacency effect called Eberhard effect: high values of Δ contrast result in a more brilliant colored image above all in the case of colored subjects on a different color background.

EXAMPLE 2

A multilayer color photographic film, Film C, was prepared similarly to Film B of Example 1 with the following changes only:

layer (b) had a silver coverage of 0.66 g/m² and a coupler coverage of 0.405 g/m², and layer (c) had a silver coverage of 1.68 g/m² and a coupler coverage of 0.436 g/m².

A second multilayer color photographic film, Film D, was prepared similarly to Film B of Example 1 with the following changes, only:

layer (b) had a silver coverage of 0.57 g/m² and a coupler coverage of 0.35 g/m², and layer (c) had a silver coverage of 1.80 g/m² and a coupler coverage of 0.466 g/m².

Samples of the two films were exposed and treated as described in Example 1.

The following table reports the sensitometric results.

| FILM | C | D |
|---|---|---|
| MAXIMUM OPTICAL DENSITY | | |
| Layer b | 0.93 | 0.80 |
| Layer c | 1.0 | 1.07 |
| Layer d | 0.24 | 0.23 |
| CONTRAST | | |
| (i) | 0.61 | 0.59 |
| (ii) | 0.74 | 0.69 |
| %Δ CONTRAST | | |
| $\left(\frac{ii - i}{i} \cdot 100\right)$ | +21.3 | +16.9 |

(i) = exposure through grey 0.3 wedge.
(ii) = exposure through grey 0.3 wedge + W29R filter.

Sensitivity differences and granularity of Films C and D resulted substantially similar to those of Film B of Example 1. Δ contrast resulted high for both films having a triple cyan layer construction according to the present invention.

EXAMPLE 3

A multilayer color photographic film, Film E, was prepared by coating a cellulose triacetate film, subbed with gelatin, with the following layers in the following order:

(a) the layer of black colloidal silver dispersed in gelatin of Film A of Example 1;

(b) a layer of low sensitivity red-sensitive silver bromo-iodide emulsion (having 7% silver iodide moles and a mean grain size of 0.25μ) at a silver coverage of 0.79 g/m² and a gelatin coverage of 1.48 g/m², having the two color couplers of layer (b) of Film A at a coverage of 0.46 g/m² dispersed in tricresylphosphate;

(c) a layer of medium sensitivity red-sensitive silver halide emulsion comprising a blend of a medium sensitivity silver chloro-bromo-iodide emulsion (having 7% silver iodide moles, 5% silver chloride moles and a mean grain size of 0.35μ) and a high sensitivity silver bromo-idodide emulsion (having 7% silver iodide moles and a mean grain size of 0.7μ) at a total silver coverage of 1.45 g/m² and a gelatin coverage of 2.58 g/m², containing the two cyan dye forming couplers of Film A at a coverage of 0.385 g/m² dispersed in tricresylphosphate;

(d) a layer of a high sensitivity red-sensitive silver halide emulsion comprising a silver bromo-iodide emulsion (having 7% iodide moles and a mean grain size of 1μ) at a silver coverage of 1.9 g/m² and a gelatin coverage of 1.24 g/m², containing the two cyan dye forming couplers of Film A at a coverage of 0.146 g/m² dispersed in tricresylphosphate;

then with the layers (e) to (m) of Film A in the same order.

A second multilayer color photographic film, Film F, was prepared similarly to Film E with the following changes only:

layer (b) had a silver coverage of 0.75 g/m² and a coupler coverage of 0.396 g/m²;

layer (c) had a silver coverage of 1.5 g/m² and a coupler coverage of 0.34 g/m²; and layer (d) had a silver coverage of 2.5 g/m² and a coupler coverage of 0.25 g/m².

Samples of the two films were exposed and treated as described in Example 1. The following table reports the sensitometric results.

| FILM | E | F |
|---|---|---|
| MAXIMUM OPTICAL DENSITY | | |
| Layer b | 0.95 | 0.80 |
| Layer c | 0.76 | 0.69 |
| Layer d | 0.29 | 0.50 |
| % CONTRAST | +15.0 | +18.0 |

We claim:

1. Multilayer color photographic light-sensitive material having on a support base blue-, green- and red-sensitized silver halide emulsion layers associated with non-diffusing color couplers, wherein at least one of the silver halide emulsion layers comprises three silver halide emulsion layers sensitized to the same spectral region of visible light, the uppermost silver halide emulsion layer of which has the highest sensitivity and the lowermost silver halide emulsion layer has the lowest sensitivity, characterized in that the maximum color density of the uppermost silver halide emulsion layer, after development, is lower than 0.60 and the maximum color densities of both the intermediate and the lowermost silver halide emulsion layers, after color development, are each higher than 0.60.

2. Multilayer color photographic material according to claim 1, wherein the sum of the maximum color densities of the uppermost silver halide emulsion layer and intermediate silver halide emulsion layer is higher than 1.0.

3. Multilayer color photographic material according to claim 1, wherein the sum of the maximum color densities of the uppermost silver halide emulsion layer and intermediate silver halide emulsion layer is equal or higher than the maximum color density of the lowermost silver halide emulsion layer.

4. Multilayer color photographic material according to claim 1, wherein the red-sensitized silver halide emulsion layer in the indicated order comprises a fine-grain low-sensitivity silver halide emulsion layer, a mean-grain medium-sensitivity silver halide emulsion layer and a coarse-grain high-sensitivity silver halide emulsion layer, said fine-grain low-sensitivity silver halide emulsion layer being the closest one to the supporting base in said red-sensitized layer.

5. Multilayer color photographic material according to claim 1 which consists of a supporting base having coated thereon in the indicated order: an antihalation layer, three layers of silver halide emulsion sensitized to the red light but of different sensitivity and containing cyan-dye forming couplers, two layers of silver halide emulsion sensitized to the green light but of different sensitivity and containing magenta-dye forming couplers, a yellow dye filter layer, two layers of silver halide emulsion sensitized to the blue light but of different sensitivity and containing yellow-dye forming couplers.

6. Multilayer color photographic material according to claim 1 wherein the silver halide emulsions utilize gelatin as dispersing medium.

7. Multilayer color photographic material according to claim 1 comprising non-diffusing color couplers dispersed therein.

8. Multilayer color photographic material according to claim 1 wherein the concentration of the color coupler in the intermediate medium-sensitivity silver halide emulsion layer is 2 to 10 times the concentration of the color coupler in the uppermost highly sensitive silver halide emulsion layer.

9. A process for the production of color images which comprises exposing the material of claim 1 to a colored object and developing the exposed material in a color forming developer.

10. Colored images produced by the process claimed in claim 9.

* * * * *